United States Patent [19]

Vicinanza et al.

[11] Patent Number: 4,643,081

[45] Date of Patent: Feb. 17, 1987

[54] LOUVER SYSTEM WITH ADJUSTABLE SLATS, FEATURING REMOVABLE MODULAR SLAT CLIPS

[75] Inventors: Camillo Vicinanza, Pontecagnano; Felice Del Giudice, S. Antonio di Pontecagnano, both of Italy

[73] Assignee: Pillar Naco Industries (Europe) Srl, Salerno, Italy

[21] Appl. No.: 812,234

[22] Filed: Dec. 23, 1985

[30] Foreign Application Priority Data

May 6, 1985 [IT] Italy ..... 48171 A/85

[51] Int. Cl.[4] ..... F24F 13/16

[52] U.S. Cl. ..... 98/114; 98/110; 98/121.2; 137/601

[58] Field of Search ..... 98/110, 114, 121.2; 137/601

[56] References Cited

U.S. PATENT DOCUMENTS 197,583 11/1877 Allen ..... 98/121.2 X
3,547,152 12/1970 Hess ..... 137/601
4,244,397 1/1981 Magill et al. ..... 98/121.2 X
4,275,762 6/1981 Field ..... 98/121.2 X
4,469,132 9/1984 Redington ..... 98/110 X

*Primary Examiner*—Harold Joyce
*Attorney, Agent, or Firm*—Thomas R. Vigil

[57] ABSTRACT

The louver system disclosed is of a basic type with adjustable-angle slats arranged between two uprights (1) provided with holes in which swivel mounts (3) are located for the receipt of clips (5) to which the slats (4) are fitted. The single clip (5) is embodied in two half-sections (52, 51) the mating surfaces of which incorporate a dovetailed key (6) and a matching groove (7) respectively; the two half-sections are thus able to slide relative to one another into a locked position determined by a projecting longitudinal lip (18) which, in addition to acting as a stop, prevents infiltration of water between the two half-sections, and are retained by a releasable catch mechanism (8, 9); in a preferred embodiment, one half-section (51) of each clip (5) has a flexible quadrangular element (12) designed to snap into a corresponding quadrangular socket (10) offered by the swivel mount (3).

16 Claims, 4 Drawing Figures

FIG. 2
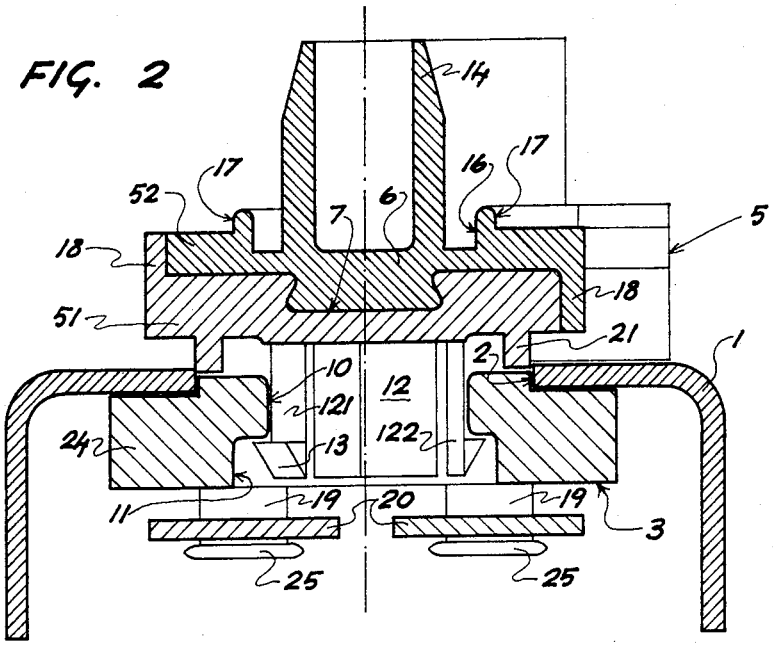
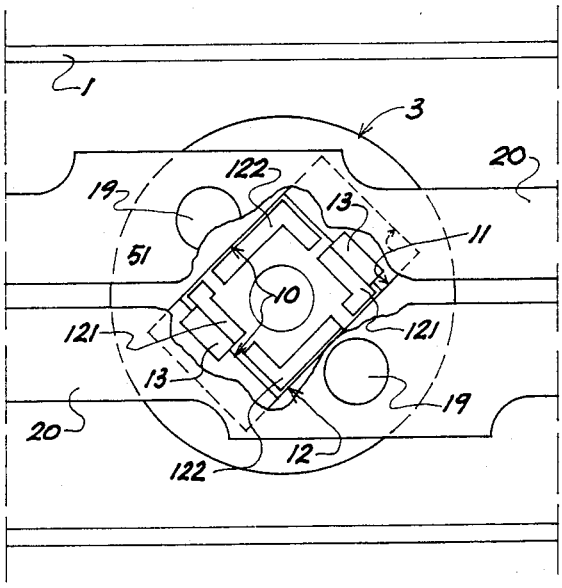
FIG. 3

LOUVER SYSTEM WITH ADJUSTABLE SLATS, FEATURING REMOVABLE MODULAR SLAT CLIPS

BACKGROUND of the INVENTION

The invention relates to a louver system of the type having adjustable slats, which features removable, modular slat chips.

Systems of the type, having slats or vanes which can be angled at will, have found widespread use in the building trade for window and ventilation fixtures etc.

The most common embodiment of such a system is one that consists essentially of a metal frame in which the slats are supported between riveted swivel mounts and clips. The single mount, which is located inside a U-shaped upright frame member, consists in essence of a plate rotatable about its own axis and riveted at one side to two rods which produce the opening and closing movement of the slat; the other side of the mount incorporates a circular projection that fits into a corresponding hole in the upright.

The clip is formed with a pair of parallel lips designed to grip the relative slat from either side, and a pair of top and bottom teeth the purpose of which is to prevent the slat from sliding in relation to the parallel lips.

The control rods are also located within the U profile of the upright, and a lever, riveted to the rods and projecting from the upright, provides the means of rotating mounts and slats together in one direction or the other.

Such louver systems certainly provide economy from the construction standpoint, but can prove impractical, especially as regards assembly, since the entire unit must be put together prior to its location in the fixture; riveting operations likewise present practical problems.

In order to avoid such drawbacks, and at the same time provide the option of utilizing extruded aluminum slats (in response to a steadily increasing demand for that material), a second type of louver system has been developed, in which the single clip exhibits a first insertable part that fits into an axial socket in the slat, and a second insertable part that fits into a socket offered by a relative swivel mechanism, the swivel mechanism itself being lodged in a longitudinal channel incorporated into the upright frame member.

The single swivel mechanisms are located one above the other in the channel of the upright, and lock together in such a way that rotation of one of the slats causes the remainder to rotate simultaneously in like manner.

A system of this type must also be assembled before it can be lodged in the fixture, though the alternative does exist of exploiting the uprights of the fixture itself as upright frame members for the louver, provided that these incorporate a channel in which to accommodate the slat swivel mechanisms, and have holes affording passage to the second insertable part of the clips.

With this second type of system, one gains a certain advantage in terms of modular design, though the result is lacking in economy by reason of the complex constructional nature of parts such as the uprights and the swivel mechanisms; what is more, no solution is offered to the problem of how slats may be removed without dismantling the entire louver, a problem which remains similarly unsolved in the type of system first mentioned.

The object of the invention described herein is that of eliminating those drawbacks outlined in the foregoing preamble.

SUMMARY of the INVENTION

The stated object is realized with a louver system as described in the following specification and as defined in the appended claims, i.e. a system which permits economical embodiment of a louver of the first-mentioned type, wherein the angle of the slats is adjustable, and wherein one or more single slats, or even all the slats, can be replaced without there being any need to dismantle the entire louver frame.

One of the advantages offered by the invention is that of marked simplicity in terms of design, construction and assembly, a feature which invests the system with genuine economy and dependability.

Another advantage of the invention is that it affords the option of fitting the slats with the louver frame already positioned in the fixture; this signifies that the frame can be accurately squared up with and adapted to the fixture before fitment of the slats, which is then accomplished in rapid time. The speed with which such fitment is possible is obtained by virtue of the fact that the locking method adopted, a simple sliding fit, is one whereby the clip half-sections located outermost are fixed to their relative swivel mounts without any obstruction whatever from the slats, whereas the innermost half-sections can be fitted to the slats independently of the frame. The final step of fitting the slats into the frame is particularly swift, since all that is required is to slide the keys of the half-sections fitted to the slats into the grooves offered by the half-sections fixed to the swivel mounts, and urge home so that their respective catches engage.

A further advantage of the invention is that it permits of changing the slats swiftly and simply, say, according to the season, or to preferred visual effect. It thus becomes possible with the system as disclosed herein to purchase two types of slat, one of which transparent, such as glass or plastic, and the other non-transparent, such as aluminum or wood. The non-transparent slats could be fitted during the summer season to attenuate light, whilst affording a degree of ventilation, whereas the transparent slats will provide a double glaze window during winter if kept in the closed position. Again, slats differing in color and/or design one from the other could be fitted to the frame, and similarly, the slats could be removed altogether for a given period to permit installation of, say, an air conditioner.

Yet another advantage of the invention is that by providing the clips with lips and beads, one obtains total exclusion not only of the light, but also of draft, rain and dust.

BRIEF DESCRIPTION of the DRAWINGS

An embodiment of the invention will now be described by way of example, with reference to the accompanying drawings, in which:

FIG. 2 is the axial section through a slat clip, seen fitted to the respective mount and without the slat;

FIG. 3 shows the swivel mount-clip-and-rod assembly of a louver system according to the invention, viewing from the side and in isolation from the fixture;

DESCRIPTION of the PREFERRED EMBODIMENT

Figure 1:
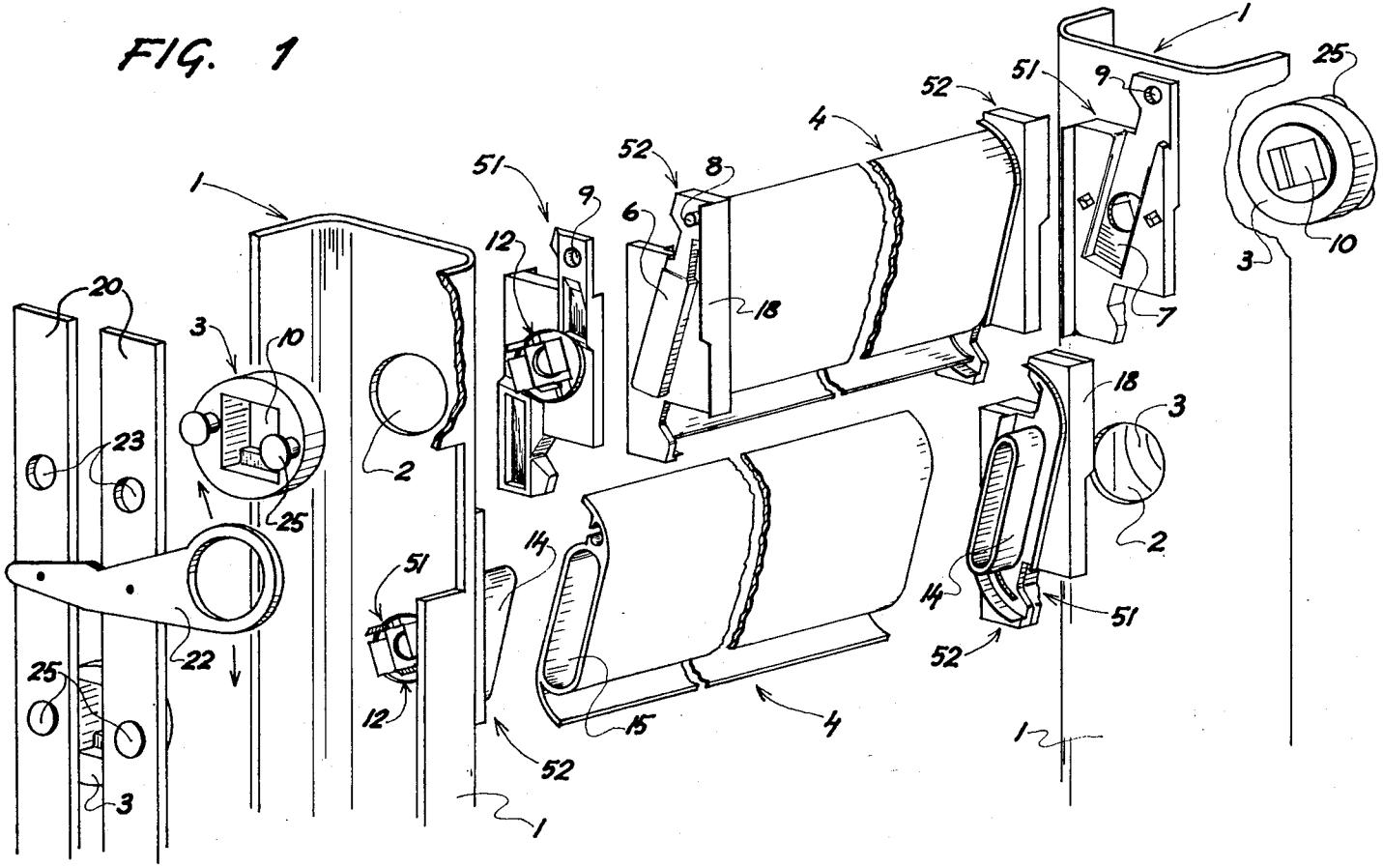
FIG. 1 is an exploded view of the essential parts of a louver system with adjustable slats according to the invention, seen in perspective.
Figure 4:
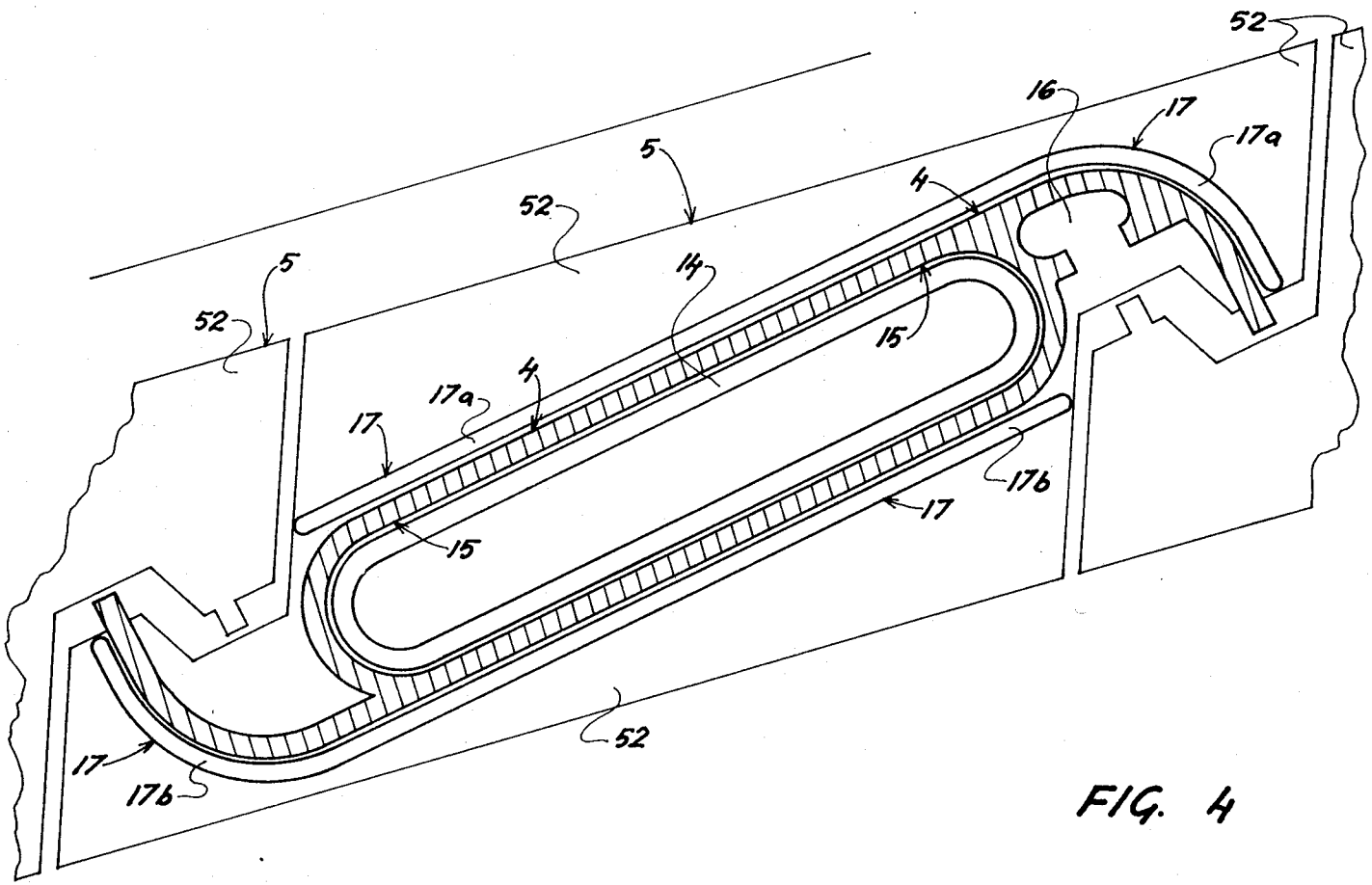
FIG. 4 shows the clip of a louver system according to the invention, viewed in section corresponding to the cross section of the slat, and seen in the fully closed position.

FIG. 1 provides an illustration of a louver system with adjustable slats, which is limited to a pair of uprights 1, a set of slats 4 with relative clips 5 and swivel mounts 3, and two swivel rods 20.

In effect, the two uprights 1 are U-section members, positioned with open side directed outwards and provided with a series of holes 2 the spacing of which defines the distance between adjacent slats 4, as will become apparent. The slats 4 in the example illustrated are extruded aluminum, exhibiting a substantially S-shaped cross-section the hollow center of which creates a longitudinal socket 15.

The clips 5, which are twice as many in number as the slats 4, are of shape similar to that of the slats 4, and have an insertable part, or plug 14 at one side which is designed to fit into the longitudinal socket 15 at one relative end of the slat 4. The other side of the clip incorporates a circular boss 21 of diameter slightly less than that of the holes 2 in the uprights 1.

Each mount 3 is substantially in the form of a plate with pins 19 projecting at the side farthest from the uprights, which engage the swivel rods 20. The side of the swivel mount 3 opposite the pins 19 incorporates a shallow spigot 24 the axial length of which is marginally less than the thickness of the frame upright 1 and the diameter of which matches that of the boss 21 offered by the clip 5. With the clip 5 locked to a relative swivel mount 3, and the upright 1 in between them, the assembled clip 5 and mount 3 can be rotated relative to the upright by operation of the swivel rods 20.

Besides engaging the mounts 3, the swivel rods 20 are interconnected by a lever 22 projecting from the upright 1 which serves to select the angle of the slats 4.

In the louver system disclosed, each clip 5 is embodied in two half-sections 51 and 52 the opposed surfaces of which incorporate matching profiles 6 and 7 that serve to lock the two together. The half-section denoted 52 (see also FIG. 2) is provided at one side with the aforementioned insertable plug 14 which slots into one end of the slat 4, and at the other side with a slide-fitting key 6; the half-section denoted 51 is provided at one side with the boss 21, and at the other with a slide-fitting groove 7 having one open end which, with the frame installed, is located uppermost. In order to ensure that the two half-sections 51 and 52 may slide only in reciprocal fashion with the key 6 located in its corresponding groove 7, the key and groove will be dovetailed or similarly restricted, as in FIG. 2.

The two half-sections 51 and 52 are further provided with a catch mechanism which in the example of FIG. 1 consists of a pin 8 projecting from the top surface of the key 6, integral with one of the half-sections 52, and a corresponding hole 9 set in the base of the groove 7 of the other half-section 51.

16 denotes a recess incorporated into the inner half-section 52 and surrounding the insertable plug 14, the outermost edge of which is bounded by a raised excluder bead 17 projecting from the half-section 52 itself, and exhibiting a shape that substantially matches the profile of a slat 4. As the slat 4 will normally project beyond the edges of the clip at top and bottom, the bead 17 is divided into two parts, one of which, denoted 17*a*, will remain on the inside of the room enclosed by a fixture incorporating the louver system disclosed; the remaining part 17*b* will be situated on the outside, following fitment of the slats. Such beads 17 prevent the passage of air, water, light and dust between a slat 4 and a corresponding clip 5 in the event that these do not mate with 100% accuracy along their joined surfaces.

Each half-section 51 and 52 is provided further with a lip 18 projecting perpendicularly from one of its longitudinal edges, which is designed to cover the corresponding longitudinal side face of the other half-section, and thus prevent infiltration of water, air or other foreign matter between the half-sections themselves. An additional purpose of these lips 18 is that of creating a close fit of the clips 5 with the uprights 1, thereby preventing infiltration of air, water, light or dust, without obstructing smooth rotation of the clip.

It will be observed in FIG. 1 that the key 6 of half-section 52 and the groove 7 of half-section 51 are angled in relation to the longitudinal axis of the half-sections themselves; the lips 18 thus act as stops when the half-sections 51 and 52 are slid together.

The single half-section 51 and its relative swivel mount 3 are joined by a snap fit (see FIGS. 2 and 3) between a through holes, or socket 10 of polygonal shape in the swivel mount 3, and a matching polygonal element 12 integral with the outermost half-section 51 which engages therein; the socket 10 illustrated, by way of examaple, is quadrangular.

The quadrangular socket 10 in each mount 3 is enlarged at the side farthest from the spigot 24, in order to create a similarly quadrangular seat 11. The quadrangular element 12 of each half-section 51 is divided into four component parts comprising two opposed and offset matching pairs. Two of these component parts 121 may be defined as tongues, issuing from opposite corners of the quandrangular element, each of which is provided with a retaining lip 13 designed to engage in the quadrangular seat 11 of a relative swivel mount 3. The remaining two component parts 122 of the quadrangular element 12 exhibit an L shape, and constitute the two remaining corners of the element 12.

It will be obvious that the component parts denoted 122 make no contact with the other two component parts 121 of the quadrangular element 12, as the two parts 121 in question must be drawn together when slotted into or extracted from the quadrangular hole 10 of the relative mount 3. The configuration of the quadrangular element 12 is such that it can be freed from the swivel mount 3 only by applying a certain pressure to the two component parts 121 with the retaining lips 13 in simultaneous fashion, so as to urge them together until close enough to clear the inside walls of the quandrangular hole 10.

Each swivel mount 3 engages with the rods 20 by way of two pins 19 set in positions on the mount which are diametrically opposed in relation to its axis, the rods 20 being provided with corresponding holes 23. The diameter of the pins 19 is marginally less than that the holes 23 in order to permit of rotation of the swivel mount 3 relative to the rod 20; the pins 19 are provided with heads 25 that prevent their accidental separation from the rods 20 once fitted, the size of which, however, is such as to permit such separation by application of a given pressure.

In order to obtain economy of manufacture, and to build a certain degree of flexibility into snap-fitted parts such as the quadrangular element 12 of the outer half-section 51, the half-section 51 itself, and the heads 25 of the pins 19, the entire swivel assembly comprising clip 5 and mount 3 would be fashioned from plastic or synthetic material, or at all events a material possessing the requisite flexibility.

The assembly of a louver system with adjustable slats thus disclosed is swift and simple, and is accomplished as described below.

First, the spigots 24 of the swivel mounts 3 are located in their respective holes 2 in the uprights 1, whereupon the single clip half-sections 51 are fitted to the mounts 3 by inserting the quadrangular element 12 of each one into the quadrangular socket 10 of the relative mount 3. Next, the swivel rods 20 are connected to the mounts 3 by location of the pins 19 of the mounts 3 in the holes 23 of the rods 20; this done, the control leverl 22 is fitted to the rods 20. The entire frame is now assembled, offered to the fixture and squared up. The remaining half-sections 52 are fitted to the louver slats 4 independently of the frame-assembly operation, slotting the plugs 14 of the half-sections 52 into the sockets 15 offered by the slats 4. Assembly of the louver can now be brought to completion, according to the invention, by sliding the keys 6 of the half-sections 52 fitted to the slats into the corresponding grooves 7 of the half-sections 51 fitted to the swivel mounts 3, hence to the frame. The key 6 of the one half-section 52 slides along the groove 7 of the other half-section 51 until the lip 18 of each half-section 51 and 52 locates against the corresponding longitudinal side face of the matching half-section 52 and 51; on arrival of the half-section 52 at this point, its catch pin 8 snaps into the hole 9 of the relative frame half-section 51.

A louver system according to the invention is thus assembled in a short time, and the slats 4 can be removed simply by separation of the two clip half-sections 51 and 52 to a degree that will permit disengagement of the catch pins 8 from their relative holes 9.

The entire system likewise can be dismantled without damaging any part, since all components are joined together by snap fits.

What is claimed:

1. A louver system with adjustable slats featuring removable modular slat clips, comprising: a frame with two parallel uprights (1), each upright (1) having an identical series of holes (2) which are spaced a predetermined distance apart; a series of single swivel mounts (3), each swivel mount (3) being rotatably accommodated within a hole (2) in one of the uprights (1); a set of single clips (5), each clip (5) being insertable into a swivel mount (3); and a set of slats (4) supported by and between a pair of the clips (5) by connection of each end of a single slat (4) to a respective clip (5); wherein each single clip has a first half-section (51) and a second half-section (52), the first half-section (51) of which is snap-fitted to a respective swivel mount (3), and the second half-section (52) of which is insertable into one respective end of a slat (4), with the mutually opposed surfaces of the half-sections (51, 52) having matched sliding-fit profiles (6, 7) for permitting the half-sections (51, 52) to slide bodily relative to one another from a first position in which one profile (6) locates in the other (7) to a second position in which the two half-sections (51, 52) of the clip lock together; and wherein the half-sections (51, 52) of each clip (5) are locked together by a releasable snap-fit catch mechanism (8, 9) incorporated into the clip (5).

2. Louver system as in claim 1 wherein each of the single swivel mounts (3) has a centrally-aligned through polygonal socket (10) from which a similarly polygonal seat (11) extends at the side of the mount (3) farthest from the clip (5); and wherein the first half-section (51) of each clip (5) connected with the swivel mount (3) has a polygonal element (12) fashioned to match the shape of the polygonal socket (10) offered by the mount (3), the polygonal element (12) being divided into a number of component parts (121, 122) certain of which are offset, flexible, and provided with respective retaining lips (13) that engage in the polygonal seat (11).

3. Louver system as in claim 1 wherein the slats (4) are hollow, and the single clips (5) have an insertable plus ((14) matching the shape of a socket (15) within each hollow end of a single slat (4), and wherein the half-section (52) of the clip that engages with one end of the single slat (4) is provided with a recess (16) circumscribed internally by the insertable plug (14), and is bounded externally by a raised excluder bead (17) that projects from the surface of the half-section (52) and is of a shape substantially matching the profile of one end of the slat (4).

4. Louver system as in claim 1 wherein each one of the half-sections (51, 52) of a single clip (5) has a lip (18) projecting perpendicularly from a loongitudinal edge and covering a corresponding longitudinal side face of the mating half-section (52, 51) of the clip (5) and is designed to prevent infiltration of water, air, light and/or other foreign matter between the half-sections (51, 52) of the single clip, and between the assembled clip (5) and the relative upright (1).

5. Louver system as in claim 1 wherein the two matched profiles (6, 7) are rectilinear, and angled slightly with respect to the longitudinal axis of the single clip (5) with which they are integral.

6. Louver system as in claim 5 wherein the two matched profiles (6, 7) are disposed through a path that lies substantially in the same plane as that which defines the angle of the slat (4).

7. Louver system as in claim 1 wherein each one of the half-sections (51, 52) of a single clip (5) has a lip (18) projecting perpendicularly from a longitudinal edge and covering a corresponding longitudinal side face of the mating half-section (52, 51) of the clip (5) and is designed to prevent infiltration of water, air, light and/or other foreign matter between the half-sections (51, 52) of the single clip; wherein the two matched profiles (6, 7) are rectilinear, and angled slightly with respect to the longitudinal axis of the single clip (5); and wherein the perpendicular lip (18) of each clip half-section (51, 52) functions as a stop when the half-sections are slid together toward the position in which they are locked together.

8. Louver system as in claim 1 wherein the matched slide-fitting profiles of the half-sections (51, 52) of each clip (5) are in the form of a key (6) on one section and a corresponding groove (7) on the other section, the shape of the key and the groove being such that, when slotted together, the two half-sections (51, 52) may slide relative to one another, but are prevented from separating.

9. Louver system as in claim 1 wherein the catch mechanism consists of a pin (8) integral with one of the half-sections (51 or 52) of the single clip p(5), projecting perpendicularly therefrom at one end, at least, of the matched profile (6, 7), and a corresponding hole (9)

offered to the pin by the remaining half-section (51, 52) of the same clip (5).

10. Louver system as in claim wherein the polygonal socket (10) of each swivel mount (3) and the polygonal element (12) of the clip half-section (51) inserted therein are quadrangular; and wherein the component parts (121) of the polygonal element (12) that are provided with a retaining lip (13) are disposed at opposite sides thereof.

11. Louver system as in claim 1, wherein at least the clips (5) are fashioned from plastic or synthetic material, or at all events from a material possessing sufficient flexibility to permit release both of the single clip half-sections (51, 52), one from the other, and of the clips (5) themselves from their respective swivel mounts (3).

12. Louver system as in claim 1 wherein the swivel mounts (3) are caused to rotate by way of parallel rods (20) accommodated in the uprights (1), and wherein a side of each mount (3) facing toward the rods (20) is provided with a pair of pins (19) located in positions diametrically opposed in relation to the axis of the mount (3) and which are insertable by snap-fitting into corresponding holes (23) offered in the rods (20) in such a way as to be rotatable within the holes (23).

13. Louver system as in claim 5 wherein the matched slide-fitting profiles of the half-sections (51, 52) of each clip (5) are in the form of a key (6) and a corresponding groove (7) the shape of which is such that, when slotted together, the two half-sections (51, 52) may slide relative to one another, but are prevented from separating.

14. Louver system as in claim 6 wherein the matched slide-fitting profiles of the half-sections (51, 52) of each clip (5) are in the form of a key (6) and a corresponding groove (7) the shape of which is such that, when slotted together, the two half-sections (51, 52) may slide relative to one another, but are prevented from separating.

15. Louver system as in claim 7 wherein the matched slide-fitting profiles of the half-sections (51, 52) of each clip (5) are in the form of a key (6) and a corresponding groove (7) the shape of which is such that, when slotted together, the two half-sections (51, 52) may slide relative to one another, but are prevented from separating.

16. Louver system as in claim 2 wherein at least the clips (5) are fashioned from plastic or synthetic material or at all events from a material possessing sufficient flexibility to permit release both of the single clip half-sections (51, 52), one from the other and of the clips (5) themselves from their respective swivel mounts (3).

* * * * *

UNITED STATES PATENT AND TRADEMARK OFFICE

CERTIFICATE OF CORRECTION

PATENT NO. : 4,643,081

DATED : February 17, 1987

INVENTOR(S) : Camillo Vicinanza et al.

It is certified that error appears in the above-identified patent and that said Letters Patent is hereby corrected as shown below:

Column 1, Line 10 - "chips" should be --clips--

Column 2, Line 38 - delete "of" before"changing"

Column 4, Line 60 - Insert --of-- before "the"

Column 4, Line 61 - Delete "of" before "rotation"

Column 5, Line 18 - "leverl" should be --lever--

Column 5, Line 55 - Insert --(5)-- before "has"

Column 6, Line 15 - "plus" should be --plug--

Column 6, Line 15 - "((14)" should be --(14)--

Column 6, Line 26 - "loongitudinal" should be --longitudinal--

Column 6, Line 66 - Delete "p" before "(5)"

Column 7, Line 3 - Insert --2-- before the word "wherein"

UNITED STATES PATENT AND TRADEMARK OFFICE

CERTIFICATE OF CORRECTION

PATENT NO. : 4,643,081

DATED : February 17, 1987

INVENTOR(S) : Camillo Vicinanza et al

It is certified that error appears in the above-identified patent and that said Letters Patent is hereby corrected as shown below:

Column 8, Line 20 - Insert --,-- after the word "material"

Signed and Sealed this

Eighteenth Day of August, 1987

*Attest:*

DONALD J. QUIGG

*Attesting Officer*

*Commissioner of Patents and Trademarks*